US007484575B2

(12) United States Patent
Angelle et al.

(10) Patent No.: US 7,484,575 B2
(45) Date of Patent: Feb. 3, 2009

(54) CONDUCTOR PIPE STRING DEFLECTOR AND METHOD

(75) Inventors: Jeremy R. Angelle, Lafayette, LA (US); Guy R. Brasseux, Houston, TX (US)

(73) Assignee: Frank's Casing Crew & Rental Tools, Inc., Houston, TX (US)

( * ) Notice: Subject to any disclaimer, the term of this patent is extended or adjusted under 35 U.S.C. 154(b) by 282 days.

(21) Appl. No.: 11/115,481

(22) Filed: Apr. 27, 2005

(65) Prior Publication Data

US 2006/0243485 A1 Nov. 2, 2006

(51) Int. Cl.
*E21B 7/18* (2006.01)

(52) U.S. Cl. ..... 175/67; 175/424; 166/358

(58) Field of Classification Search ..... 166/366, 166/358; 175/5–10, 61, 67, 424, 45
See application file for complete search history.

(56) References Cited

U.S. PATENT DOCUMENTS 2,745,647 A * 5/1956 Gilmore ..... 299/5
3,191,695 A * 6/1965 Bates et al. ..... 175/5
3,191,697 A * 6/1965 Haines ..... 175/81
3,199,613 A * 8/1965 Malott et al. ..... 175/5
3,215,202 A * 11/1965 Pollard et al. ..... 166/341
3,265,130 A * 8/1966 Watkins ..... 166/342
3,664,442 A * 5/1972 Rosser et al. ..... 175/231
3,738,434 A * 6/1973 Nelson ..... 175/6
3,788,396 A * 1/1974 Shatto et al. ..... 166/341
3,899,032 A * 8/1975 Rees et al. ..... 175/9
RE28,860 E * 6/1976 Marshall et al. ..... 175/9
3,987,639 A * 10/1976 Harrison et al. ..... 405/224
4,214,842 A * 7/1980 Franks ..... 405/191
4,527,639 A * 7/1985 Dickinson et al. ..... 175/61
4,624,606 A * 11/1986 Nakanishi et al. ..... 405/269
4,808,037 A * 2/1989 Wade et al. ..... 405/226
4,930,586 A * 6/1990 Turin et al. ..... 175/25
4,957,173 A * 9/1990 Kinnan ..... 175/61
5,288,173 A * 2/1994 Jenne et al. ..... 405/184
5,366,030 A * 11/1994 Pool et al. ..... 175/215
5,368,106 A * 11/1994 Coughlin ..... 169/70
6,142,234 A * 11/2000 Crain ..... 166/341
6,648,084 B2 * 11/2003 Morey et al. ..... 175/67

(Continued)

*Primary Examiner*—Thomas A Beach
(74) *Attorney, Agent, or Firm*—Matthews, Lawson & Bowick, PLLC

(57) ABSTRACT

An apparatus for deflecting a tubular string preferably comprising at least one side nozzle near the lower end of a first tubular string. The nozzle permits passage of a fluid therethrough from the first tubular string bore and deflects the first tubular string in a substantially horizontal direction. A second tubular string may be lowered over the deflected first tubular string. The second tubular string and the first tubular string are preferably lowered into the sea floor for maintaining their deflection. A method for deflecting a first tubular string and securing the first tubular string in the deflected state preferably comprises lowering the first tubular string axially so that the lower end of the first tubular string is near the sea floor. Preferably, a fluid, such as seawater, is propelled down through the bore of the first tubular string and through at least one side nozzle near the lower end of the first tubular, wherein the fluid moving through the side nozzle deflects the first tubular string. The first tubular string end is preferably lowered into the sea floor for maintaining the deflection of the first tubular string. A second tubular string may then be slidably lowered over the first tubular string for deflecting the second tubular string.

23 Claims, 12 Drawing Sheets

U.S. PATENT DOCUMENTS 6,920,945 B1 * 7/2005 Belew et al. ..... 175/67
7,083,011 B2 * 8/2006 Meyer ..... 175/424
7,090,153 B2 * 8/2006 King et al. ..... 239/553
7,240,744 B1 * 7/2007 Kemick ..... 175/106
2006/0175094 A1 * 8/2006 Falgout ..... 175/61
2006/0260809 A1 * 11/2006 Crain ..... 166/277
2007/0125577 A1 * 6/2007 Brunet ..... 175/62

* cited by examiner

CONDUCTOR PIPE STRING DEFLECTOR AND METHOD

FIELD OF THE INVENTION

This invention pertains to apparatus and method for the deflection of a tubular string which may be suspended from a drilling or service rig or platform.

BACKGROUND OF THE INVENTION

Subsea production systems can range in complexity from a single satellite well with a flowline linked to a fixed platform or an onshore installation, to several wells on a template or clustered around a manifold, and transferring to a fixed or floating facility, or directly to an onshore installation. Subsea production systems can be used to develop reservoirs, or parts of reservoirs, which require drilling of the wells from more than one location. Deep water conditions, or even ultra-deep water conditions, can also inherently dictate development of a field by means of a subsea production system, because traditional surface facilities such as on a steel-piled jacket, might be either technically unfeasible or uneconomical due to the water depth.

Subsea hydrocarbon. e.g., oil and gas, extraction has an exceptionally safe record and has been going on for approximately 100 years. Oil and gas fields reside in deep water and shallow water around the world. When they are under water and tapped into for the hydrocarbon production, these are generically called subsea wells, fields, projects, development, or other similar terms. Subsea production systems can be used to develop reservoirs, or parts of reservoirs, which require drilling of the wells from more than one location.

The development of subsea oil and gas fields requires specialized equipment. The equipment must be reliable enough to safe guard the environment, and make the exploitation of the subsea hydrocarbons economically feasible. The deployment of such equipment requires specialized and expensive vessels, which need to be equipped with diving equipment for relatively shallow equipment work, i.e., a few hundred feet water depth maximum, and robotic equipment for deeper water depths. Any requirement to repair or intervene with installed subsea equipment is thus normally very expensive. This type of expense can result in economic failure of the subsea development.

On occasion, it is necessary to lower a string of pipe from a drilling platform or drilling barge or other above water structure or vessel down through the water and into the previously drilled portion of the subbottom borehole. For example, during the drilling of the well bore, it becomes necessary to pull the drill string out of the hole and back aboard the drilling platform or vessel for purposes of changing the drill bit. Then, the drill string is lowered through the water and into the subbottom well bore for purposes of continuing the drilling operation.

The pipe lowering operation is difficult for various identifiable reasons. For example, a string of pipe is to be lowered from a floating vessel, down through several hundred feet of water and into the mouth of a subbottom well bore on the order of eight inches in diameter. Obviously, there is a problem in getting the bottom end of the pipe string or drill string to hit the mouth of the well bore. The dilemma is similar to threading a needle from a distance of several hundred feet. The problem is further complicated by the fact that a string of pipe having a length of several hundred or several thousand feet is flexible and is readily subject to being deflected by movement of the vessel or underwater currents.

There are no satisfactory means of directing the bottom end of a string of pipe to the mouth of a subbottom well bore, other than by moving the surface ship or platform and rotating the pipe in the hope that the pipe string and the mouth of the well bore will come into alignment with one another. As a consequence, directing the bottom end of a string of pipe to the mouth of a subbottom well bore is very time consuming at best and may, in some cases, be impossible to accomplish.

SUMMARY OF THE INVENTION

An apparatus for deflecting a tubular having a tubular wall comprising an aperture in the tubular wall, and a nozzle mounted within the aperture in the tubular wall. The nozzle is an integral part of the tubular wall. The nozzle has a progressively decreasing inside diameter for defining a progressively converging flow path such that any fluid passing through the progressively converging flow path has a velocity that increases as the fluid passes through the progressively converging flow path. Such flow causes the static pressure exerted by the fluid to decrease, the velocity to increase and the ram pressure to increase. The ram pressure increases to a maximum pressure as the fluid exits the nozzle. The fluid moving through the tubular is directed through said nozzle, and the fluid moving through the nozzle creates a jet flow with a maximum ram pressure which deflects the tubular in a direction substantially opposite the direction of the fluid flow through said nozzle.

DETAILED DESCRIPTION OF PREFERRED EMBODIMENTS

It should be understood that the description herein below may use the terms drill string, pipe string, or the more general term tubular or tubular string interchangeably without intention of limitation. It should be further understood that the device and method described herein can be applied to tubulars other than drill string, casing, or tubing.

Figure 1:
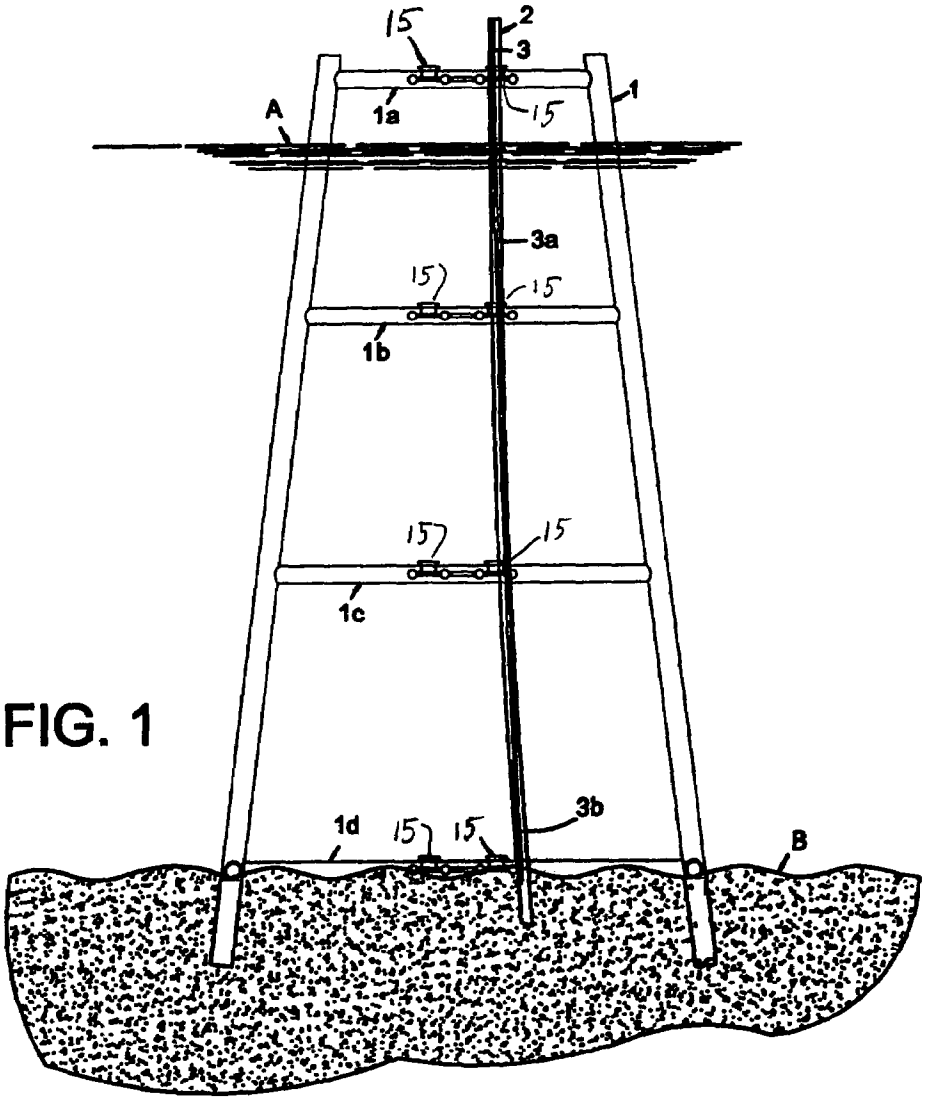
FIG. 1 illustrates a side elevated view of the lower portion of an offshore installation utilizing the deflector apparatus according to the present invention.

FIG. 1 illustrates the lower portion of a typical fixed offshore platform 1. It is well known in the art that the platform structure stands in the seabed B, is preferably anchored in a conventional manner, and preferably has vertically distributed braces such as illustrated by braces 1*a-d*. It is further well known that the platform comprises a plurality of "slots" through which one or more wells can be drilled. Typically, guide sleeves 15 are mounted to the braces 1*a*-1*d* and are substantially vertically aligned with the "slots". Typically, tubulars, used for drilling and production operations are lowered through the "slots" and the corresponding vertically aligned guide sleeves 15. Such slots and guide sleeves are conventional and well known in this art.

It is well known that due to size constraints of the platform 1, the number of "slots" is limited. It is further known that if a wellbore, which corresponds to a particular "slot" and its vertically aligned guide sleeves 15 becomes unuseable, that "slot" also becomes unuseable unless the tubular string, which is to be lowered through the unuseable "slot" can be deflected, from a substantially vertical position, in order to position a new wellbore proximate the unuseable wellbore. It is still further well known, in the art, that a wellbore becomes unuseable for a variety of reasons, including but not limited to, the existing well being depleted, or to stuck tubulars or tools, adverse borehole conditions, and the like. Typically, in an unuseable wellbore, the tubulars are cut off below the mudline and are abandoned for the purposes of the drilling and/or production operations. Typically, after the unuseable wellbore is abandoned, all tubulars are removed from the corresponding "slot" and its vertically aligned guide sleeves 15. Therefore, the "slot" is only unuseable from the point of view of utilizing a substantially vertical tubular string.

Still referring to FIG. 1, when a "slot" is to be recovered, a new tubular string 2 is lowered through the particular "slot" and must be deflected, in a substantially horizontal direction, to bypass the unuseable wellbore. According to the present apparatus, this deflection is preferably accomplished by utilizing a jet sub 3*b* as further described herein below.

Figure 3:
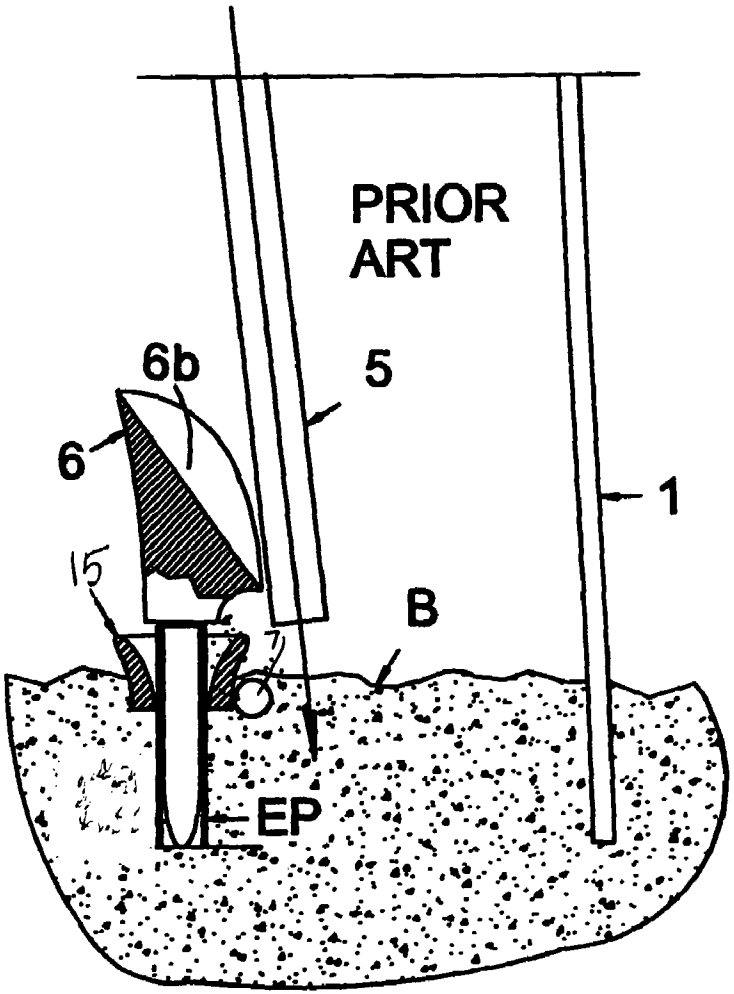
FIG. 3 illustrates a side elevated view of an alternative prior art system involving a whipstock that has been speared into an abandoned well pipe.
Figure 2:
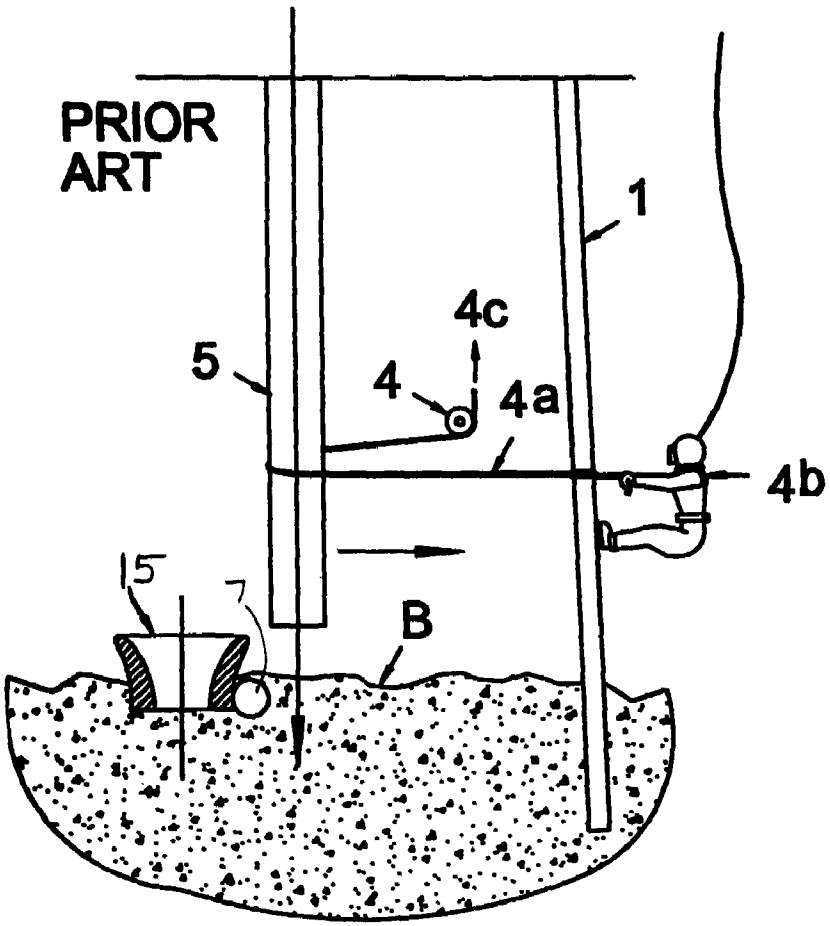
FIG. 2 illustrates a side elevated, diagrammatic view of a prior art system involving a selected portion of the installation of the embodiment illustrated in FIG. 1 with a diver and winch line in use intending to be used to be used to laterally shift the upper portion of a separated tubular string.

FIGS. 2 and 3 illustrate a pair of prior art systems for attempting the tubular string deflection necessary for the "slot" recovery. FIG. 2 illustrates the use of a diver 4B to secure a winch line or cable 4*a* to the platform 1 in an attempt to deflect a pipe 5 in a substantially horizontal direction. A pulley 4 is secured to the platform 1. Line 4*a* hooks around the pipe 5 and pulley 4 and leads to the surface and a winch on the platform. However, this method for deflecting a pipe string presents several problems including the fact that underwater diving operations are inherently risky and weather conditions must be acceptable for divers to operate. Therefore, the procedure is often suspended during inclement weather conditions causing unpredictable delays to the offshore operations.

FIG. 3 illustrates using a whipstock 6 which is typically speared into the top of an existing pipe EP that has been cut off below the mud line. The whipstock wedge surface or trough 6*b* serves to guide and deflect the descending pipe string 5 horizontally. However, this method for deflecting a pipe string also presents several problems including difficulty in stabbing the whipstock into the existing pipe and the probability that the tubular string will permanently separate from the whipstock.

Figure 4:
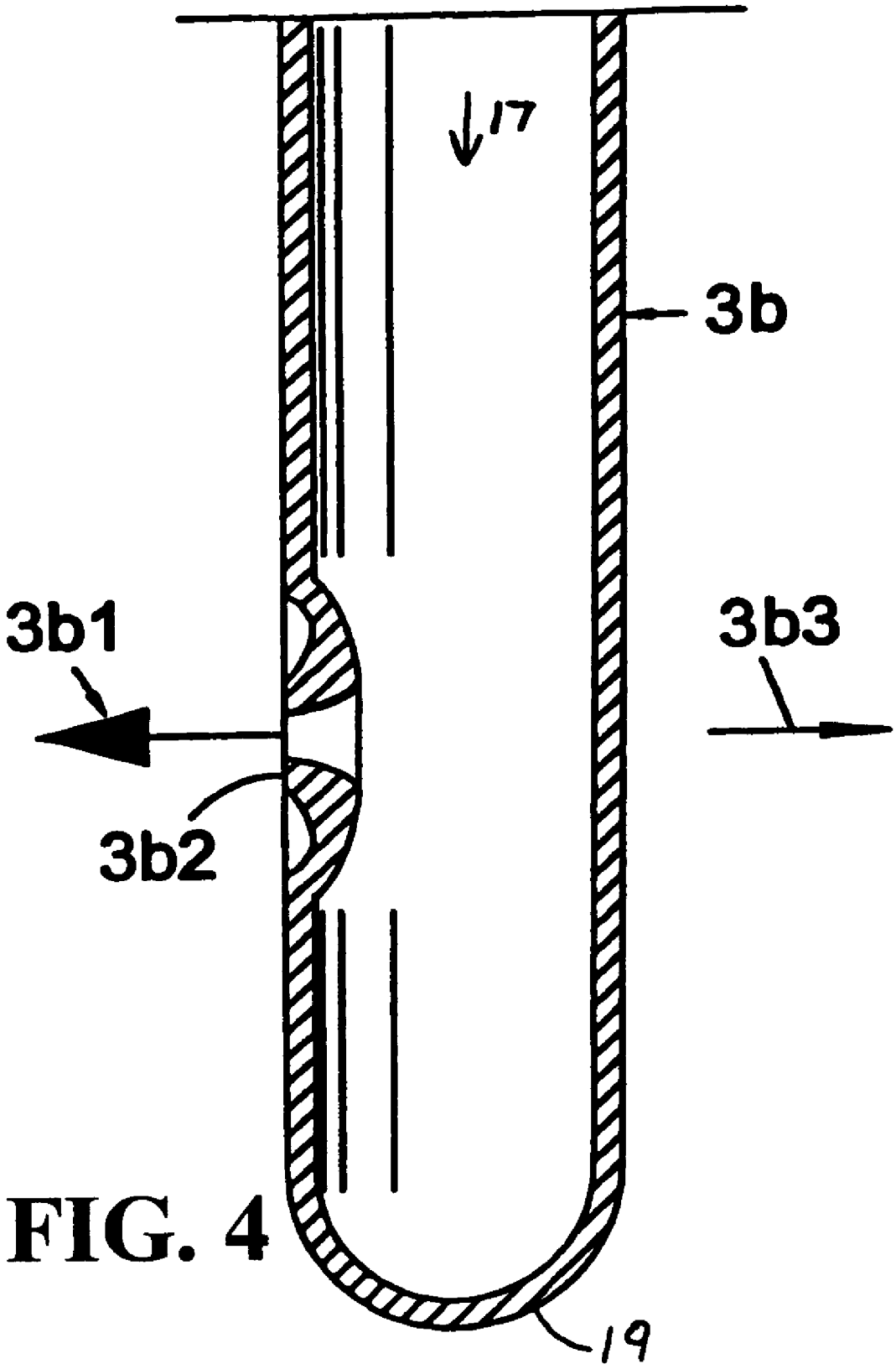
FIG. 4 illustrates a cross-sectional elevated side view of a deflector sub according to the present invention.
Figure 5:
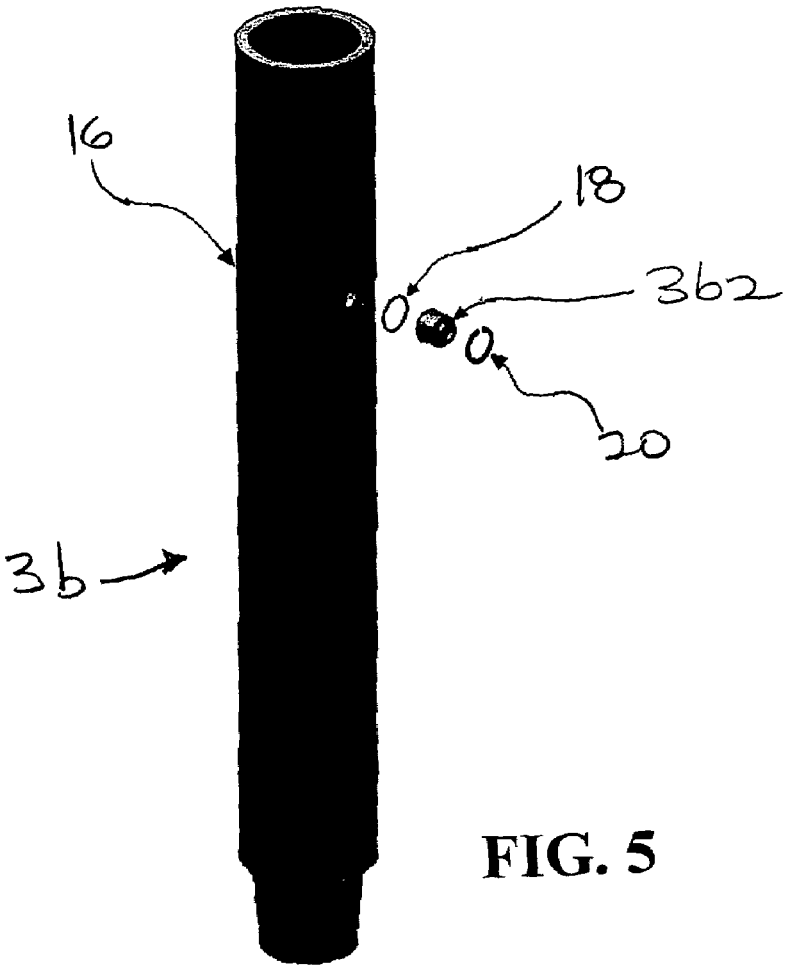
FIG. 5 illustrates an exploded, elevated perspective view of an alternative embodiment of a deflector sub according to the present invention.
Figure 6:
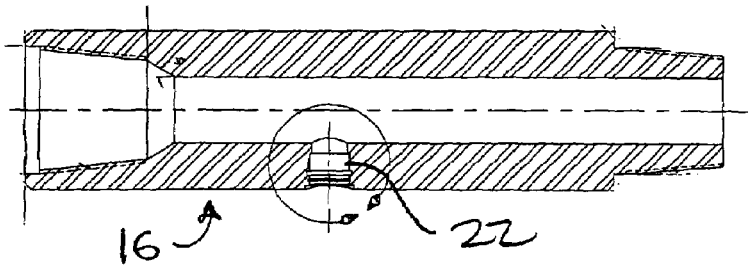
FIG. 6 illustrates a longitudinal, cross-sectional view of the embodiment illustrated in FIG. 5 according to the present invention.
Figure 7:
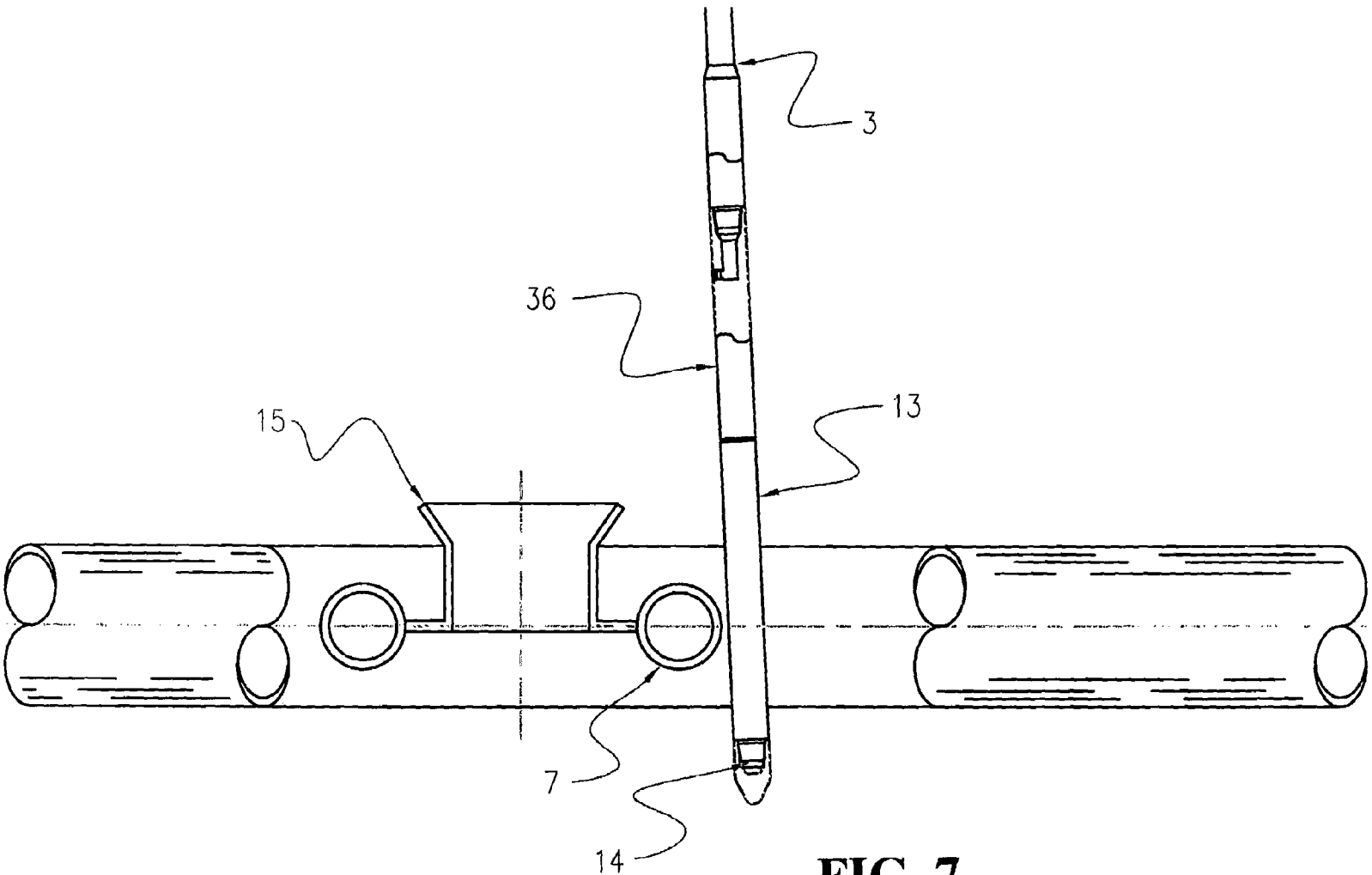
FIG. 7 illustrates a side view, partially cut away, of an alternative embodiment of the deflector sub according to the present invention.

FIGS. 4-7 illustrate embodiments of the deflector sub 3*b*, according to the present invention. FIG. 4 illustrates the basic structure and operation of the deflector sub 3*b*. Preferably, the deflector sub 3*b* has a closed end 19. However, it should be appreciated that the deflector sub 3*b* does not have to be positioned at the lowermost end of the tubular string 3, illustrated in FIG. 1. The deflector sub 3*b* may be positioned uphole or behind additional subs or devices (FIG. 7). It should be further appreciated that the deflector sub 3 may comprise various top and bottom connections, such as, but not limited to, box and pin connections respectively, and as such, the closed end 19 may be a separate structure attached to the deflector sub 3*b* by threaded attachment, welding, or any other means of conventional attachment or may be located downhole of the deflector sub 3*b*.

Preferably, pumps, or other fluid driving devices, such as the rig pumps may push or propel seawater or other fluid into the tubular string 3 in the general direction indicated by the arrow 17. The selection of the fluid, being pumped into the tubular string 3 may be dependent on the environment, particularly the environment into which the fluid will be discharged. Preferably, the seawater, or other fluid, is pumped through the tubular string 3 and into the deflector sub 3*b*.

Preferably a jet nozzle 3*b*2 is positioned in the sidewall of the deflector sub 3*b* and becomes the outlet for the seawater or other fluid being pumped through the deflector sub 3*b*. As the fluid exits through the nozzle 3*b*2 it will produce a fluidjet 3*b*1. The fluidjet 3*b*1, in turn, preferably produces a thrust 3*b*3, in a substantially opposite direction from the fluid jet 3*b*1 and thus moves the deflector sub in the direction of the thrust 3*b*3. It should be appreciated that the amount of pressure in the bore of the tubular string 3 and the nozzle 3*b*2 size influences the amount of the thrust force 3*b*3, which in turn substantially determines the amount of deflection of the tubular string 3. It should be appreciated, by those skilled in the art, that nozzle 3*b*2 is typically a commercially available item and can be found in a variety of sizes. However, the utilization of non-commercial or non-conventional nozzle sizes should not be viewed as a limitation of the present apparatus or method.

Figure 6A:
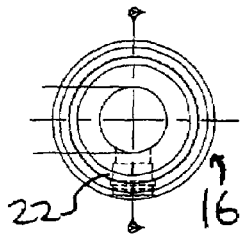
FIG. 6A illustrates an end plan view of the embodiment illustrated in FIG. 6 according to the present invention.
Figure 6B:
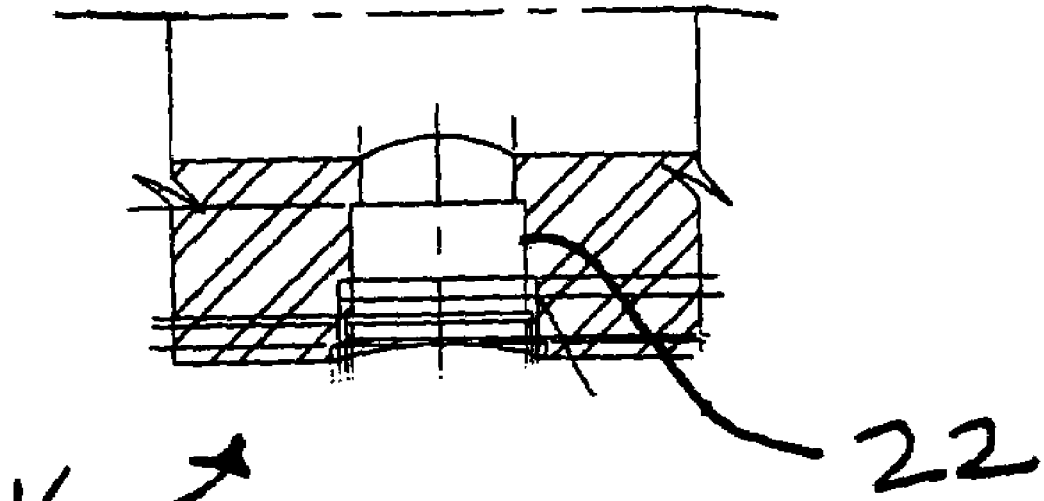
FIG. 6B illustrates an enlarged, detail view, partly in cross section of the nozzle-receiving portion of the deflector sub body illustrated in FIG. 6A according to the present invention.

FIG. 5 illustrates further detail of the deflector sub 3*b* which preferably comprises a deflector sub body 16, nozzle 3*b*2, O-ring 18, and retaining ring 20. It should be appreciated that nozzle 3*b*2, O-ring 18, and retaining ring 20, whether commercially available or specifically manufactured for a particular application, are well known in the art and will not be described in detail herein. FIGS. 6 and 6A illustrate cross-sectional, longitudinal and end views, respectively, of deflector sub body 16. Orifice 22 is preferably machined in the wall of the deflector sub body 16 for receiving the nozzle 3*b*2. FIG. 6B is an enlarged view of orifice 22 in the wall of the deflector sub body 16.

FIG. 7 illustrates an alternative embodiment of the invention in which deflector sub 3*b* is installed behind or uphole from a bit sub 13 located at the end of tubular string 3. Bit sub 13 is preferably plugged at its lower end 14 in order to allow fluid and pressure, in the drill string or tubular string 3, to discharge through nozzle 3*b*2. The guide tubular 3 is illustrated as passing beside a bay brace 7 which resides on the exterior of the guide sleeve 15 through which the unusable wellbore is associated. The guide sleeve 15 is located on the lowermost horizontal rig brace id illustrated in FIG. 1.

In recovering a "slot", a drill string or tubular string 3 is preferably lowered, through the "slot" to be recovered and at least some of its corresponding vertically aligned guide sleeves 15, to a point about three to four feet above the sea floor. It should be understood that the target depth can vary depending on several factors including, but not limited to, the overall ocean depth, speed of currents, amount of desired deflection, and the size/weight of the guide string. Thus, it should be appreciated that in more adverse conditions, the deflection of the tubular string 3 may need to be initiated earlier or later (i.e. further from or closer to the sea floor) in order to accomplish the desired deflection or to avoid other objects such as, but not limited to, other drill strings, or other drilling related operations. The position of tubular string 3 may then be verified with a measurement device such as a gyroscope. The tubular string 3 is then preferably deflected by energizing a deflector sub 3*b* which is preferably attached to the end of the tubular string 3.

Figure 8:
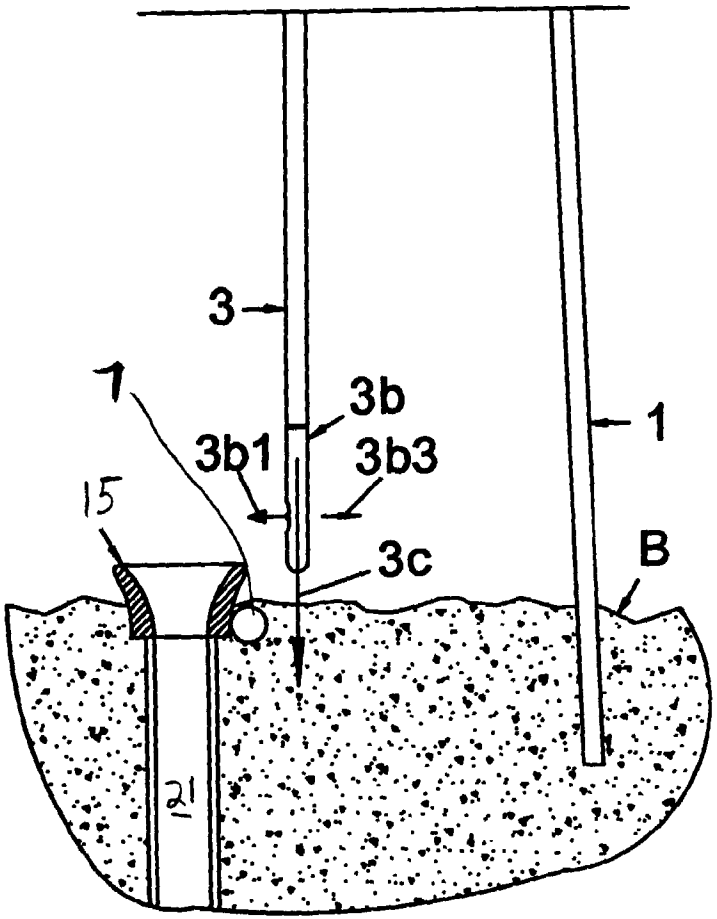
FIG. 8 illustrates a side elevated, diagrammatic view of a tubular string deflected by a fluid jet according to the present invention.

FIG. 8 illustrates tubular string 3 being deflected by the side thrust 3*b*3 being produced by the fluid jet 3*b*1. FIG. 8 further illustrates an unuseable well bore 21 (the wellbore 21 being unuseable as described herein above). The deflection, of the tubular string 3, preferably causes the tubular string 3 to bypass at least the lower most guide sleeve 15 and an unusable wellbore 21 thus recovering the previously unuseable "slot" associated with its vertically aligned guide sleeve 15 and unuseable wellbore 21. While tubular string 3 is deflected as illustrated, it is then preferably inserted or speared into the mud or sea floor B along line 3*c*. It should be understood that line 3*c* is preferably deflected, at some desired angle, from a vertical axis passing through the recovered "slot" and its vertically aligned guide sleeves 15 and the unuseable wellbore 21.

After the tubular string 3 has been inserted or speared into the sea floor B mud line (FIG. 9), the pumping of seawater is preferably stopped and measurements are taken to verify the position of the deflected drill string or tubular string 3. The tubular string 3 may then be further lowered until it preferably supports its own weight axially. It should be appreciated that the tubular string 3 will substantially sink through the mud or sediment bottom due to its own weight. It should be appreciated that as the drill pipe or tubular string 3 is lowered further into the seabed B, it will preferably retain its deflected position and not shift in a horizontal direction to its pre-deflected vertically aligned position. The tubular string 3 may then be disconnected at the rotary table (not illustrated) on the platform, leaving a portion of the string protruding through the rotary floor (not illustrated). Another pipe or tubular string 2 (FIG. 9) may then be lowered over the deflected tubular string 3.

Figure 9:
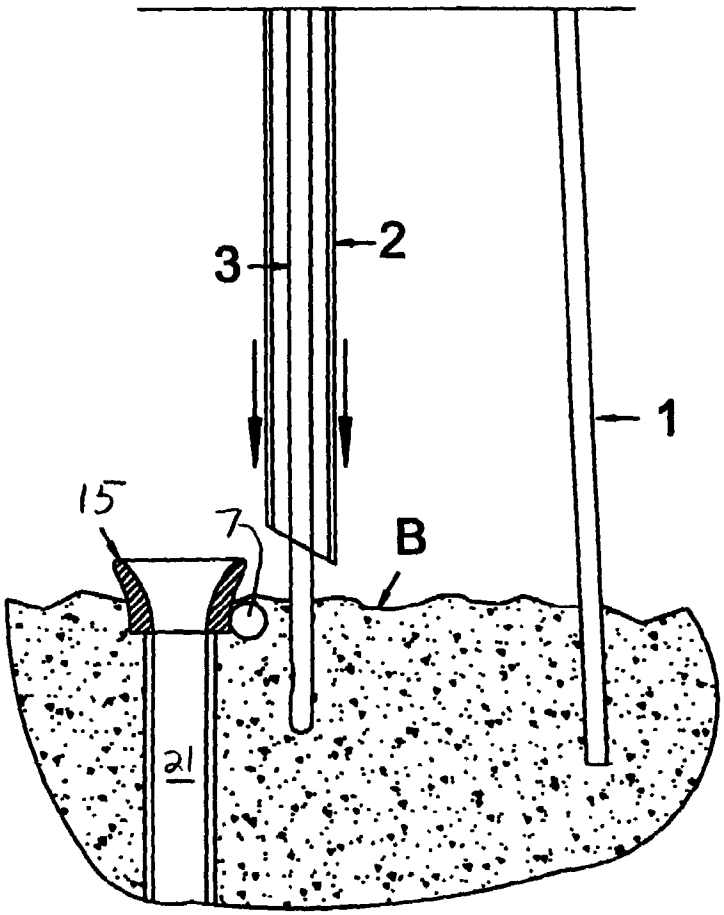
FIG. 9 illustrates a side elevated, diagrammatic view of the embodiment illustrated in FIG. 8 further illustrating a second tubular being lowered over a deflected tubular string according to the present invention.
Figure 11:
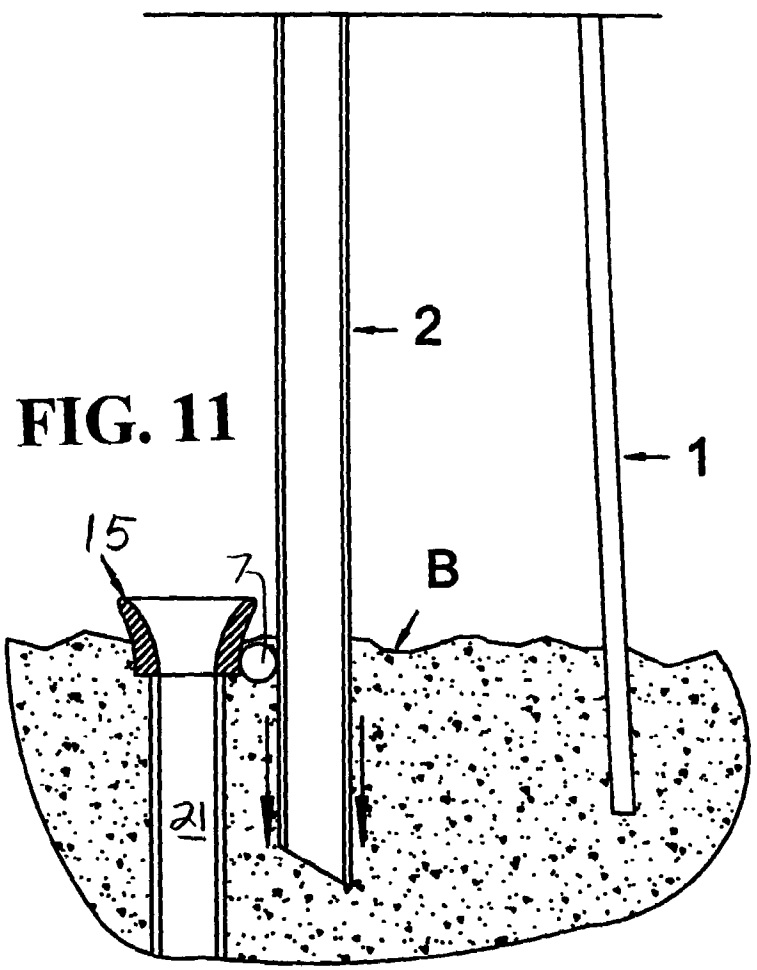
FIG. 11 illustrates a side elevated view of the internal tubular string illustrated in FIG. 10 having been removed according to the present invention.
Figure 10:
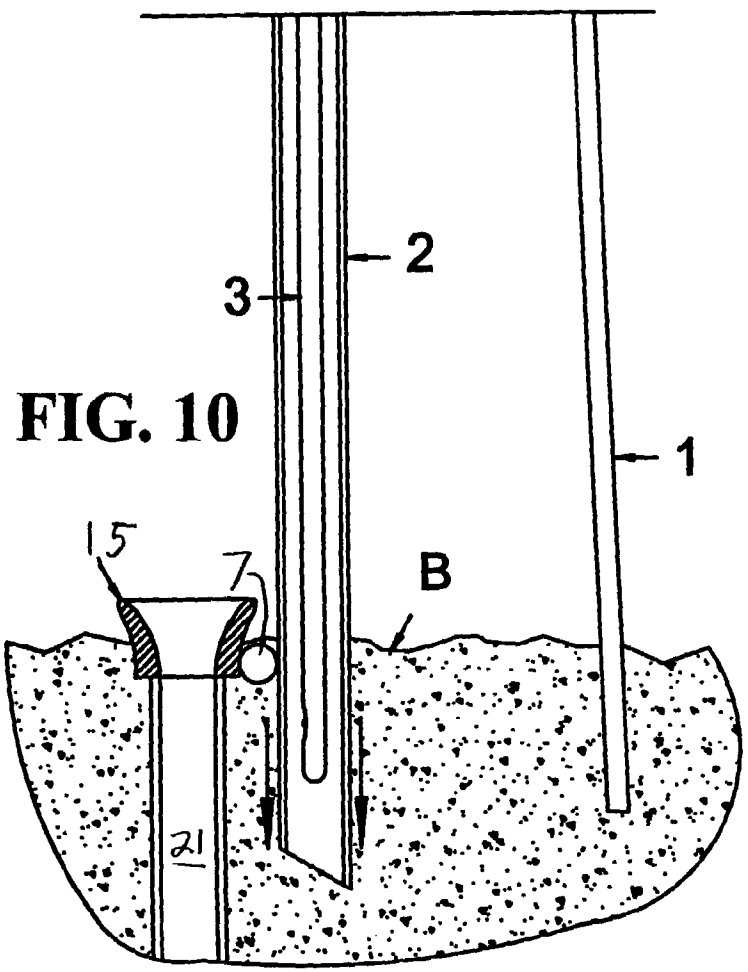
FIG. 10 illustrates a side elevated, diagrammatic view of a pair of concentric tubulars being pushed into the seabed according to the present invention.
Figure 12:
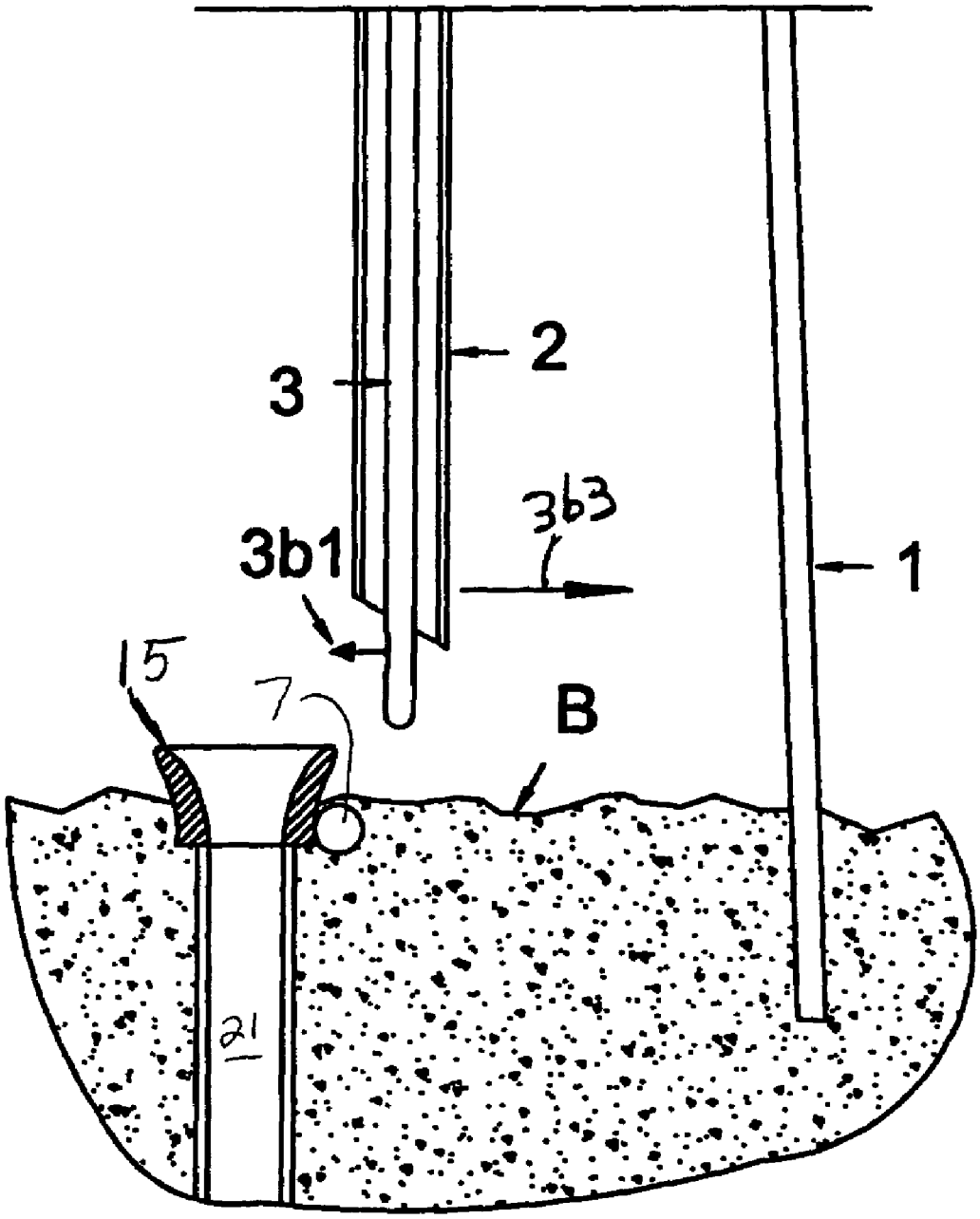
FIG. 12 illustrates a side elevated view of an alternative embodiment with the exterior tubular illustrated in FIG. 10 being in place during the deflection process according to the present invention.

FIG. 9 illustrates the drive pipe or tubular string 2 installed, preferably slid over the deflected tubular string 3. FIGS. 9, 10, and 12 illustrate the tubular string 2 and the deflected tubular string 3 being in a substantially concentric relationship. However, this is optional since in order to maintain such a substantially concentric relationship some type of centralization device (not illustrated), such as a conventional tubular centralizer, would have to be used. The deflected tubular string 3 preferably acts as a guide string to deviate the pipe string or tubular string 2 as it is lowered, over the deflected tubular or tubular string 3, to the sea floor B. The pipe string or tubular string 2 will preferably be thrust into the mud below mud line as illustrated in FIG. 10. The tubular string 3 may then be withdrawn from inside the pipe or tubular string 2, as shown in FIG. 11. It should be appreciated that the conductor bay brace 7 may also aid in the offset alignment of the drive pipe or tubular string 2. The conductor bay brace 7 will preferably aid in preventing the drive pipe or tubular string 2 from moving in a substantially horizontal direction toward the unuseable well bore 21.

FIG. 12 illustrates an alternative embodiment similar to that illustrated in FIG. 8 except that both the tubular string 3, with the deflector sub 3*b*, and pipe string 2 are installed/lowered together to a desired position above the seabed B. It should be understood that the tubular string 3 is installed/lowered while positioned in the throughbore of the pipe string 2. As described herein above, pumps may be activated to cause flow through the fluid jet 3*b*1 thus producing a side load 3*b*3 and deflecting both the tubular string 3 and tubular string 2. When deflected, both the tubular string 3 and tubular string 2 may be dropped/inserted into the mud to secure the deflected position. Further, as illustrated in FIG. 11, the inner tubular string 3 can be retrieved from the inner bore of the drive pipe or tubular string 2.

Figure 13:
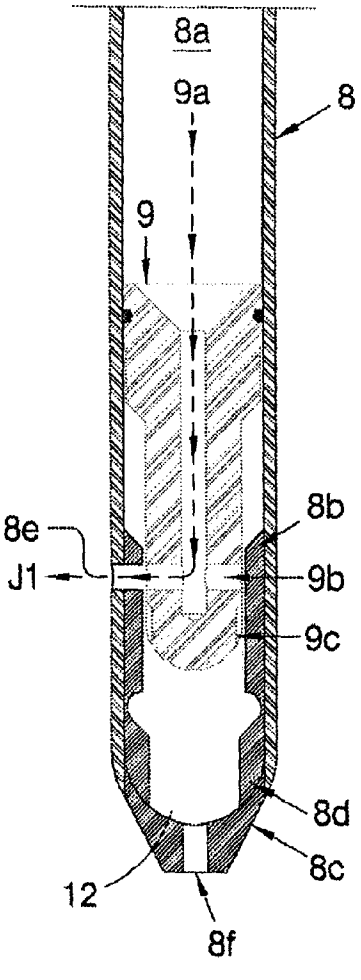
FIG. 13 illustrates a side cut away, elevated view of a jet nozzle switching apparatus, with a piston in a first position, according to the present invention.

FIGS. 13-18 show another embodiment of a deflector sub 3*b*. This embodiment will preferably allow the deflector sub to deflect the tubular string, as described herein above, and then redirect the jet flow from a side nozzle to a bottom nozzle or aperture to aid in the insertion of the drill pipe or tubular string 3 into the seabed B or "glance" off other obstructions. FIG. 13 illustrates the nozzle switching apparatus 23 which may be housed in a tubular section 8. It should be appreciated that the tubular section 8 may be attached to the end of tubular string 3, a pipe, or other tool or tubular as necessary in a manner similar to that of the deflector sub 3*b* described herein above. Preferably, the nozzle switching apparatus 23 comprises a drillable material such that the nozzle switching apparatus 23 will not restrict further drilling operations. It should be appreciated that the nozzle switching apparatus 23 may be used as part of a guide string, wherein a larger tubular string is installed over it, or the apparatus 23 may be utilized to guide and deflect the larger tubular. Still referring to FIG. 13, the nozzle switching apparatus further comprises a guide 8*b* which is preferably configured to guide the piston 9. In its first position, the piston 9, having an upper surface (unnumbered) tapered inwardly towards channel 9*a*, isolates the bore 8*a*, of the tubular section 8 from a lower cavity 12. The piston 9 preferably comprises a plurality of grooves 9*c*, disposed about the piston 9, which may engage corresponding ridges 8*d*, disposed about the inner circumference of the lower portion of the tubular section 8. The engagement of the ridges 8*d* with the grooves 9*c* will preferably prevent rotation of the piston 9 when it is necessary to drill out the nozzle switching apparatus 23 (See FIGS. 15-17). The lower most portion of the tubular section 8 preferably comprises an end 8*c* preferably having an opening 8*f*, which may be circular or non-circular, as desired.

The piston 9 is preferably configured with a central channel 9*a* bored in a substantially longitudinal direction to intersect with a cross bore 9*b* which passes through the piston 9 in a substantially radial direction. In the first position, the piston 9 is releasably secured such that the cross bore 9*b* is in fluid communication with a nozzle 8*e*. It should be understood that the piston 9 may be held in the first position by a variety of attachment means including, but not limited to shear screws, set screws, ridges, frangible supports, pins, rivets, screws, bolts, specific tolerance fits or a variety of other conventional retention means.

As with the deflector sub 3*b*, preferably a fluid, such as seawater, is pumped into the nozzle switching apparatus 23 to activate the jet flow J1 by pumping or propelling the fluid through the nozzle 8*e*. It should be understood that the fluid is pumped through the pipe or tubular string which extends from the tubular section 8 to the drilling rig or other drilling structure. As the fluid is pumped through the bore 8*a* of the tubular section 8, it will preferably enter the central channel 9*a*, move into the cross bore 9*b*, and be exhausted through the nozzle 8*e* to produce the jet J1. The jet J1 will preferably produce a thrust force in a similar manner to the jet 3*b*1 thus causing the tubular 8 and any attached tubular string to deflect in a direction substantially opposite the nozzle 8*e*.

Figure 15:
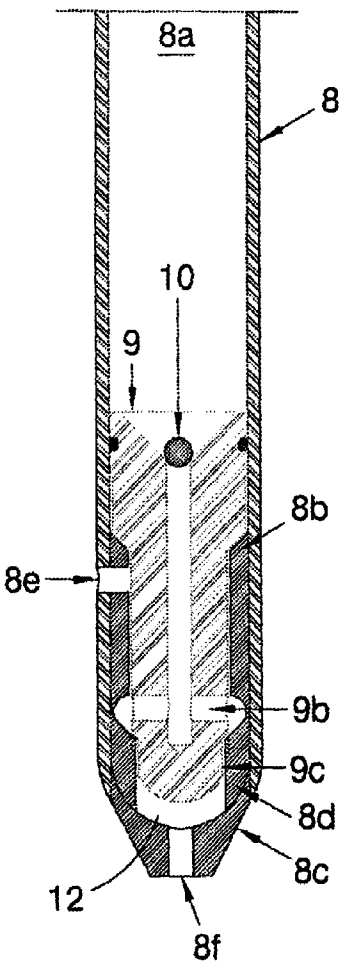
FIG. 15 illustrates a side cut away, elevated view of the embodiment illustrated in FIG. 13 with the piston in a second position according to the present invention.
Figure 14:
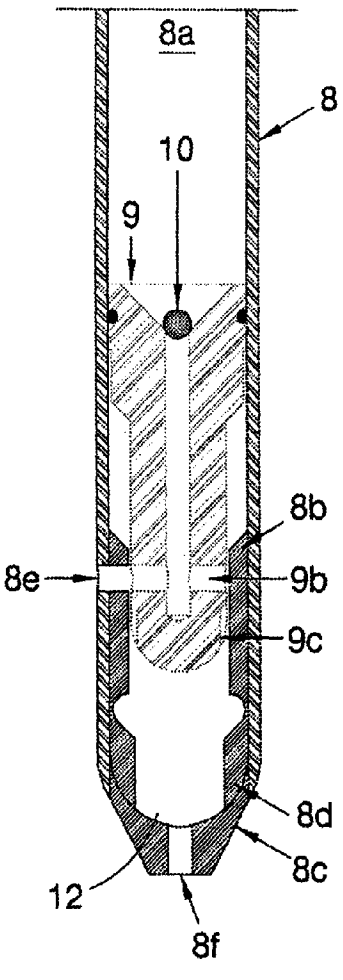
FIG. 14 illustrates a side cut away, elevated view of an alternative embodiment with a drop ball in place, with a piston in a first position, according to the present invention.

When the desired deflection is achieved and/or it is desired to switch operation from the side nozzle 8*e* to the bottom nozzle or aperture 8*f*, a ball 10 or other stopper is preferably dropped down the bore of the tubular, attached to the tubular section 8, to close channel 9*a* as illustrated in FIG. 14. With the seawater still being pumped into the bore 8*a*, the pressure builds up against the top of piston 9 and preferably forces the piston 9 downward to a second position as illustrated in FIG. 15. It should be appreciated that the pressure increase, which preferably occurs due to the ball or stopper 10 blocking channel 9*a*, will shear or break any support maintaining the piston 9 in its initial position and thus allowing for its downward travel. After the piston 9 moves from the first position, cross bore 9*b* will no longer communicate with the nozzle 8*e*. In the second position, cross bore 9*b* will preferably open to the cavity 12.

Figure 16:
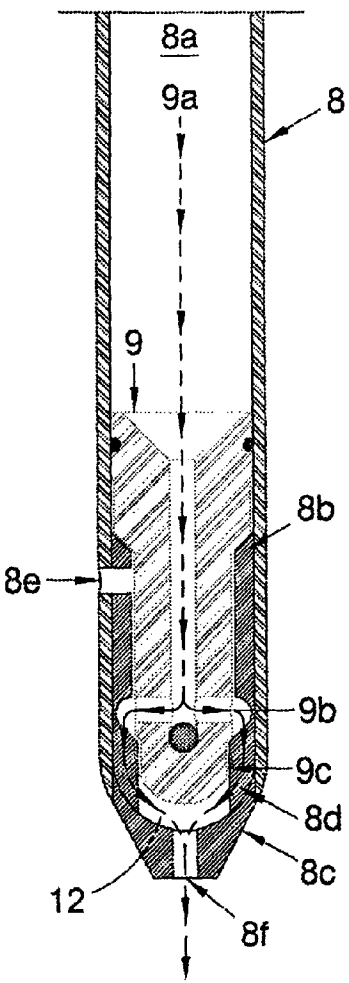
FIG. 16 illustrates a side cut away, elevated view of the embodiment illustrated in FIG. 15 with the drop ball expelled according to the present invention.

After the piston 9 has moved to the second position, the pressure in bore 8*a* is further raised to pump the ball 10 through the central channel 9*a* and the cross bore 9*b* to permit flow through the bottom hole 8*f*, as illustrated in FIG. 16. It should be understood that ball 10 may be comprised of a variety of materials including, but not limited to, elastomeric, plastic, or frangible materials such as to allow the ball 10 to deform or break in order to pass through the central channel 9*a*. After the ball 10 is pushed out of the piston 9, as illustrated in FIG. 16, any flow though the bore 8*a* is preferably directed through the bottom hole 8*f* to aid in reducing interference from mud and sediment which is preferably loosened or removed by the flow through the bottom hole 8*f*. It should be appreciated that the bottom hole 8*f* can also be configured to accept a nozzle, such as 8*e* or 3*b*1 to produce a more forceful jet flow for reducing the interference.

Figure 18:
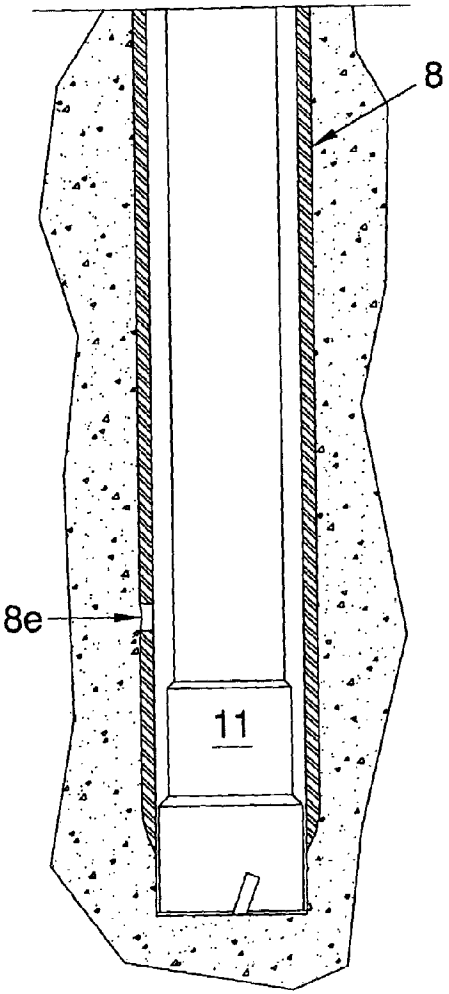
FIG. 18 illustrates a side cut away, elevated view of the embodiment illustrated in FIG. 17 with the nozzle switching apparatus drilled out according to the present invention.
Figure 17:
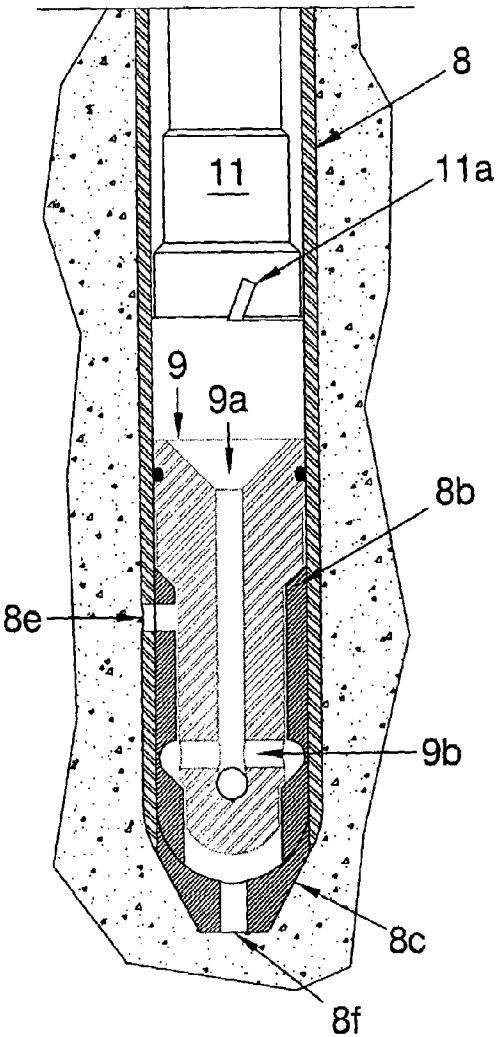
FIG. 17 illustrates a side cut away, elevated view of the embodiment illustrated in FIG. 16 further illustrating a drill bit according to the present invention.

FIG. 17 illustrates an embodiment wherein the interior components of the tubular section 8 and the attached tubular string are ready to be drilled out for subsequent activity. A milling or drilling assembly 11, which may be commonly run on a drill string, includes at least one cutter insert 11*a*. It should be understood, by those in the art, that a conventional milling or drilling assembly 11 will preferably drill or mill out substantially all material attached to the inside diameter of tubular 8. FIG. 18 illustrates the pipe string or tubular 8 after the drilling operation has been carried out. Typically, the side nozzle 8*e* can remain unplugged.

Figure 19:
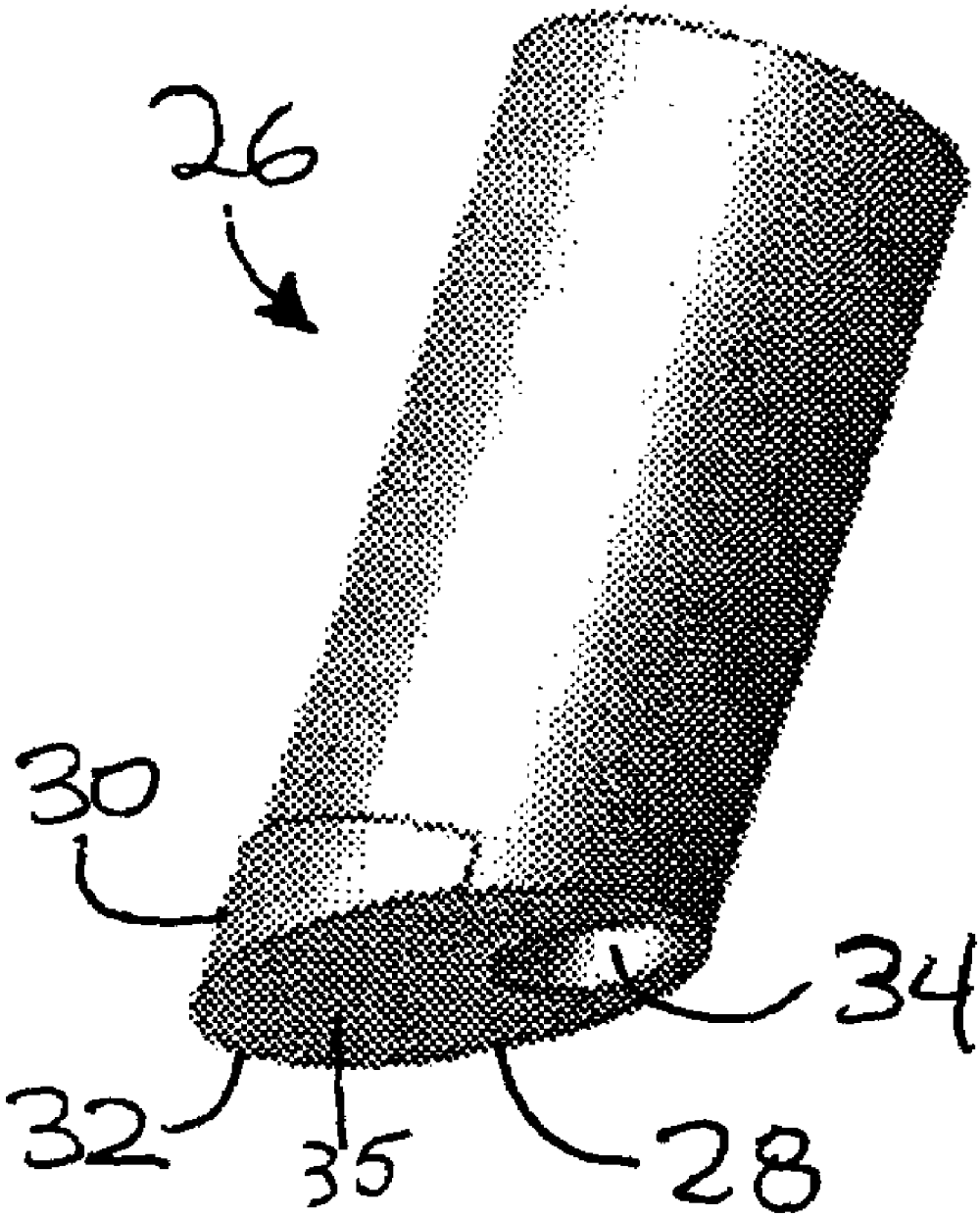
FIG. 19 illustrates an elevated, pictorial view of a closed end drive shoe according to the present invention.

Referring now to FIG. 19, the lowermost end of the drive pipe or tubular string 2 will preferably, comprise a drive shoe 26 which may be integral to the lowermost section of the drive pipe or tubular string 2 or may be a separate drive shoe attached to the lowermost section of the drive pipe or tubular string 2. It should be appreciated that the attachment of the drive shoe 26 is well know in the art and will not be described in detail herein. It should be understood, that although the embodiments illustrated herein show the lower most end of the tubular string 2 as having an angular shaped end, the shape should not be viewed as limiting. A variety of other end configurations should be included within the scope of this invention as the end serves to allow easier entry into the seabed B and aid in guiding the tubular string 2 past obstructions as it is lowered from the rig to the seabed B.

As illustrated in FIG. 19, an embodiment of the drive-shoe 26 may comprise a miter cut 28, a solid bottom end 35, and a hole 34 offset from the longitudinal centerline of the shoe 26. The solid bottom 35 may be a plug, a cap, a molded cap, a welded end, or other desirable closure member. Preferably, solid bottom 35 will be of an easy drillable, frangible, or otherwise removable material. The hole 34 allows the deflector sub 3*b*, and any attached tubulars to pass through as the larger diameter tubular 2 is lowered over the drill string or tubular string 3. The miter cut 28 preferably permits the conductor pipe 2 to "glance" off and not become hung up on the conductor bay brace 7 (FIG. 8), other tubular strings, or other drilling and production equipment should it come in contact with them. It should be appreciated that when the drive shoe 26 initially contacts the conductor bay brace 7, other tubular strings, or other drilling and production equipment there will be a point force exerted on the drive shoe 26 from the contact. The hole 34 is preferably provided so that the position of the conductor or tubular string 2 with respect to the drill pipe or tubular string 3 can be controlled. Preferably, the drive-shoe 26 on the conductor pipe or tubular string 2 will effectively "ramp" off the conductor bay brace 7 with little resistance and allow the tubular string 2 to enter the seabed B.

As further illustrated in FIG. 19, an embodiment of the drive shoe joint 26 preferably comprises a miter cut 28 with reinforcing material 30 on the long end to prevent curling of the tip 32. The remainder of the drive shoe is preferably manufactured from steel or another non-drillable material. The miter cut 28 may comprise various angles depending on factors such as, but not limited to, spacing of other guide sleeves 15 (FIG. 1), other drilling strings, casing, tubing, tool joints, tubulars, and other drilling related operations.

It should be understood that the drive shoe 26, with the miter cut 28, may also be utilized to avoid collisions with other tubular strings in a manner similar to the "glancing" effect described herein above. Further, the combination of the drive shoe 26, with the miter cut 28, and the guide string 3, similar to the embodiment illustrated in FIG. 12, may be utilized to avoid collisions by activating the fluid jet 3*b*1 in conjunction with the miter cut 28 "glancing" operation. It should also be appreciated, that when desired, fluid may also be moved through the bore of the shoe 26 such that the fluid, when exiting through the hole 34 may aid in moving the drive shoe through the softer sediment and mud.

Operation

In practicing the present invention, in order to recover the use of an existing slot which has formerly been used in an abandoned wellbore, the existing string or strings of pipe have to first be removed.

All uncemented strings of pipe, if not stuck within the wellbore, are pulled from the abandoned wellbore, and usually also any pipes remaining between the seabed and the slot to be recovered.

Any remaining strings of pipe are cut approximately eighty feet below the mudline by conventional apparatus and methods which are well known in the art of cutting tubulars such as casing cutters, production tubing cutters, drill pipe cutters, and the like. Such well-known tubular cutting technology includes the use of mechanical cutters, explosive cutters, chemical cutters, and combinations thereof.

After the existing strings of pipe have been removed, new strings of pipe are run through the recovered slot and then through the vertically spaced braces such as the guide sleeves 15 used with the braces 1*a*-1*d* discussed herein with respect to FIG. 1. The new string or strings are then run down to or into the mudline and the string or strings can then be moved laterally by the various fluid jetting processes herein described.

From the foregoing, it will be seen that this invention is one well adapted to attain all of the ends and objects hereinabove set forth, together with other advantages which are obvious and which are inherent to the tubular string deflector and method of the present invention.

The tubular string deflector and method of the present invention and many of its intended advantages will be understood from the foregoing description. It will be apparent that, although the invention and its advantages have been described in detail, various changes, substitutions, and alterations may be made in the manner, procedure and details thereof without departing from the spirit and scope of the invention. It should be understood that certain features and sub-combinations are of utility and may be employed without reference to other features and sub-combinations. This is contemplated by and is within the scope of the claims.

What is claimed is:

1. An apparatus for deflecting a tubular having a tubular wall, comprising:

an aperture in the tubular wall, and a nozzle mounted within the aperture in the tubular wall and being an integral part of the tubular wall, the nozzle for defining a converging flow path such that fluid passing through the converging flow path has a velocity that increases as the fluid passes through the converging flow path, causing the static pressure exerted by the fluid to decrease, the velocity to increase and the ram pressure to increase, the ram pressure increasing to a maximum pressure as the fluid exits the nozzle, wherein fluid moving through the tubular is directed through said nozzle, and wherein said fluid moving through said nozzle creates a jet flow with a maximum ram pressure which deflects the tubular in a direction substantially opposite the direction of the fluid flow through said nozzle.

2. The apparatus of claim 1, wherein the nozzle creates a lateral force or thrust due to a drop in pressure of the fluid.

3. The apparatus of claim 1, wherein the tubular is supported from an offshore drilling rig.

4. The apparatus of claim 3, wherein the tubular is a pipe string.

5. The apparatus of claim 3, wherein the tubular is a drill string for drilling into the sea floor.

6. The apparatus of claim 1, wherein the fluid is sea water.

7. The apparatus of claim 1, wherein a pump is used to move said fluid through said tubular bore and said nozzle.

8. The apparatus of claim 1, wherein the tubular is at least partially lowerable into the sea floor for maintaining the deflection of the tubular.

9. The apparatus of claim 1, further including a tubular string slidably inserted over the tubular.

10. The apparatus of claim 9, wherein the tubular string is at least partially lowerable into the sea floor for maintaining the deflection of the tubular string.

11. The apparatus of claim 9, further comprising a drive shoe, wherein the drive shoe is configured so as to guide the tubular string as it is slidably inserted over the tubular.

12. The apparatus of claim 11, said drive shoe further comprising:

a first end fixedly attached to the tubular string; and a second end, wherein the second end defines an aperture through which the tubular may pass while the tubular string is slidably inserted over the tubular.

13. The apparatus of claim 12, wherein the second end of said drive shoe of is configured having an angular shape.

14. An apparatus for deflecting a tubular having a tubular wall and a bore therethrough, comprising:

at least one nozzle mounted within at least one aperture, respectively, in the tubular wall wherein fluid moving through the tubular bore is directed through said at least one nozzle, and wherein said fluid moving through said at least one nozzle creates one or more jet flows which deflect the tubular in a direction substantially opposite from the vector sum of the thrusts generated by the fluid flow through said at least one nozzles, and the nozzle mounted within the aperture in the tubular wall and being an integral part of the tubular wall, the nozzle for defining a converging flow path such that fluid passing through the converging flow path has a velocity that increases as the fluid passes through the converging flow path, causing the static pressure exerted by the fluid to decrease, the velocity to increase and the ram pressure to increase, the ram pressure increasing to a maximum pressure as the fluid exits the nozzle.

15. An apparatus for deflecting a tubular conductor pipe having a tubular wall and a bore therethrough, comprising:

a nozzle mounted within an aperture in the tubular wall of said conductor pipe, wherein fluid moving through the tubular bore is directed through said nozzle, and fluid moving through said nozzle creates a jet flow which deflects the tubular conductor pipe in a direction substantially opposite the direction of fluid through said nozzle, and the nozzle mounted within the aperture in the tubular wall and being an integral part of the tubular wall, the nozzle for defining a converging flow path such that fluid passing through the converging flow path has a velocity that increases as the fluid passes through the converging flow path, causing the static pressure exerted by the fluid to decrease, the velocity to increase and the ram pressure to increase, the ram pressure increasing to a maximum pressure as the fluid exits the nozzle.

16. The apparatus as defined in claim 1 further comprising a nozzle switching apparatus.

17. The apparatus as defined in claim 14 further comprising a nozzle switching apparatus.

18. The apparatus as defined in claim 15 further comprising a nozzle switching apparatus.

19. A deflecting apparatus comprising:

(a) a tubular comprising an elongate solid portion, a hollow portion, a closed end and an open end, and (b) a jet nozzle defined by a lower section of the elongate solid portion of the tubular, the jet nozzle for defining a converging flow path such that fluid passing through the tubular and through the converging flow path has a velocity that increases as the fluid passes through the converging flow path defined by the jet nozzle, causing the static pressure exerted by the fluid to decrease, the velocity to increase and the ram pressure to increase, the ram pressure increasing to a maximum pressure as the fluid exits the jet nozzle, wherein fluid moving through the tubular is directed through the jet nozzle, and wherein said fluid moving through the jet nozzle creates an increased flow with a maximum ram pressure which deflects the tubular in a direction substantially opposite the direction of the fluid flow through the jet nozzle.

20. A deflecting apparatus comprising:

(a) a tubular comprising an elongate solid portion, a hollow portion, a restricted end and an open end, (b) an aperture defined by a lower section of the elongate solid portion of the tubular, and (c) a jet nozzle received in the aperture in the tubular, the jet nozzle for defining a converging flow path such that fluid passing through the tubular and through the converging flow path has a velocity that increases as the fluid passes through the converging flow path defined by the jet nozzle, causing the static pressure exerted by the fluid to decrease, the velocity to increase and the ram pressure to increase, the ram pressure increasing to a maximum pressure as the fluid exits the jet nozzle, wherein fluid moving through the tubular is directed through the jet nozzle, and wherein said fluid moving through the jet nozzle creates an increased flow with a maximum ram pressure which deflects the tubular in a direction substantially opposite the direction of the fluid flow through the jet nozzle.

21. A deflecting apparatus comprising:

(a) a tubular comprising an elongate solid portion, a hollow portion, a closed end and an open end, (b) a jet nozzle defined by a lower section of the elongate solid portion of the tubular, the jet nozzle for defining a converging flow path such that fluid passing through the tubular and through the converging flow path has a velocity that increases as the fluid passes through the converging flow path defined by the jet nozzle, causing the static pressure exerted by the fluid to decrease, the velocity to increase and the ram pressure to increase, the ram pressure increasing to a maximum pressure as the fluid exits the jet nozzle, and (c) a pipe string for receiving the tubular in a concentric relationship, wherein fluid moving through the tubular is directed through the jet nozzle, and wherein said fluid moving through the jet nozzle creates an increased flow with a maximum ram pressure which deflects the tubular in a direction substantially opposite the direction of the fluid flow through the jet nozzle, and the pipe string moves congruently with the deflected tubular such that the pipe string can be accurately positioned.

22. A deflecting apparatus as defined in claim 21 further comprising a drive shoe configured to guide the pipe string as it is slidably inserted over the tubular.

23. A deflecting apparatus comprising:

(a) a tubular comprising an elongate solid portion, a hollow portion, a partially closed end and an open end, (b) an aperture defined by a lower section of the elongate solid portion of the tubular, the aperture for defining a converging flow path such that fluid passing through the tubular and through the converging flow path has a velocity that increases as the fluid passes through the converging flow path defined by the aperture, causing the static pressure exerted by the fluid to decrease, the velocity to increase and the ram pressure to increase, the ram pressure increasing to a maximum pressure as the fluid exits the aperture, and (c) an insert moveably received in the hollow portion of the tubular, the insert comprising, in a first position, a channel in fluid communication with the aperture and the tubular such that fluid flows from the hollow portion of the tubular through the insert and out the aperture, wherein the fluid moving through the aperture creates an increased flow with a maximum ram pressure which deflects the tubular in a direction substantially opposite the direction of the fluid flow through the aperture, the insert further comprising, in a second position, a channel in fluid communication with the tubular and the partially closed end of the tubular such that fluid flows from the hollow portion of the tubular through the insert and out the partially closed end of the tubular, thereby terminating the ram pressure which deflects the tubular and thereby terminating the deflected movement of the tubular.

* * * * *

UNITED STATES PATENT AND TRADEMARK OFFICE

CERTIFICATE OF CORRECTION

PATENT NO. : 7,484,575 B2
APPLICATION NO. : 11/115481
DATED : February 3, 2009
INVENTOR(S) : Jeremy Richard Angelle It is certified that error appears in the above-identified patent and that said Letters Patent is hereby corrected as shown below:

In the Claims:

In Claim 14, column 10, line 36, the word "nozzles" should be --nozzle--.

Signed and Sealed this

Thirty-first Day of March, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,484,575 B2
APPLICATION NO. : 11/115481
DATED : February 3, 2009
INVENTOR(S) : Jeremy Richard Angelle et al.

It is certified that error appears in the above-identified patent and that said Letters Patent is hereby corrected as shown below:

On the Title page:

On the Title page, section (73) Assignee, the address reads, "Houston, TX (US)" and should read --Lafayette, Louisiana--.

Signed and Sealed this
Twelfth Day of July, 2011

David J. Kappos
*Director of the United States Patent and Trademark Office*